US006481829B1

(12) United States Patent
Bailey et al.

(10) Patent No.: US 6,481,829 B1
(45) Date of Patent: Nov. 19, 2002

(54) MANUALLY ACTUATED CARRIER LATCH MECHANISM

(75) Inventors: Thomas Allen Bailey, Frankfort, KY (US); Brian Andrew Naro, Lexington, KY (US); Herman Anthony Smith, Winchester, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/954,778

(22) Filed: Sep. 18, 2001

(51) Int. Cl.[7] ..... B41J 2/01
(52) U.S. Cl. ..... 347/49
(58) Field of Search ..... 347/49, 85, 86, 347/87, 39

(56) References Cited

U.S. PATENT DOCUMENTS

| | | | | |
|---|---|---|---|---|
| 4,872,026 A | | 10/1989 | Rasmussen et al. | 347/56 |
| 4,907,018 A | | 3/1990 | Pinkerpell et al. | 346/139 R |
| 5,138,342 A | | 8/1992 | Kurata et al. | 347/50 |
| 5,534,899 A | | 7/1996 | Uchikata et al. | 347/49 |
| 5,550,570 A | | 8/1996 | Kurata et al. | 347/49 |
| 5,561,450 A | | 10/1996 | Brewster, Jr. et al. | 347/49 |
| 5,619,237 A | | 4/1997 | Inoue et al. | 347/86 |
| 5,627,577 A | | 5/1997 | Buican | 347/50 |
| 5,629,725 A | | 5/1997 | Buican | 347/49 |
| 5,642,143 A | | 6/1997 | Rhoads | 347/49 |
| 5,646,665 A | * | 7/1997 | Swanson et al. | 347/87 |
| 5,682,186 A | | 10/1997 | Bohorquez et al. | 347/29 |
| 5,684,518 A | | 11/1997 | Nobel et al. | 347/50 |
| 5,748,210 A | | 5/1998 | Watanabe et al. | 347/50 |
| 5,784,082 A | | 7/1998 | Shinmachi et al. | 347/49 |
| 5,831,652 A | | 11/1998 | Hinami et al. | 347/86 |
| 5,841,453 A | | 11/1998 | Sasaki | 347/86 |
| 5,847,731 A | | 12/1998 | Kashimura et al. | 347/49 |
| 5,867,188 A | | 2/1999 | Murayama et al. | 347/37 |
| 5,870,119 A | | 2/1999 | Chen et al. | 347/49 |
| 5,936,740 A | | 8/1999 | Fukazawa et al. | 358/296 |
| 5,956,057 A | | 9/1999 | Childers et al. | 347/49 |
| 5,975,688 A | | 11/1999 | Kanaya et al. | 347/86 |
| 5,980,021 A | | 11/1999 | Nagoshi et al. | 347/49 |
| 5,992,908 A | | 11/1999 | Yared et al. | 292/196 |
| 6,007,191 A | | 12/1999 | Fujii et al. | 347/87 |
| 6,027,204 A | | 2/2000 | Hirano et al. | 347/49 |
| 6,065,826 A | | 5/2000 | Robinson et al. | 347/49 |
| 6,135,587 A | | 10/2000 | Muhl et al. | 347/49 |
| 6,152,555 A | | 11/2000 | Nozawa et al. | 347/49 |
| 6,155,678 A | | 12/2000 | Komplin et al. | 347/86 |
| 6,164,771 A | | 12/2000 | Eckard et al. | 347/86 |
| 6,170,940 B1 | | 1/2001 | Shinada et al. | 347/86 |
| 6,196,665 B1 | | 3/2001 | Weeks | 347/49 |
| 6,250,750 B1 | * | 6/2001 | Miyazawa et al. | 347/87 |

* cited by examiner

*Primary Examiner*—Michael Nghiem
(74) *Attorney, Agent, or Firm*—Elizabeth C. Jacobs

(57) ABSTRACT

A manually actuated spring loaded latch mechanism for releasably securing a printhead cartridge in a carrier of an ink jet printer. A latch cover engages the printhead cartridge and is secured by an actuator. Depressing the actuator releases the latch cover, which is spring biased to an open position. Further movement of the actuator lifts the printhead cartridge.

32 Claims, 6 Drawing Sheets

MANUALLY ACTUATED CARRIER LATCH MECHANISM

BACKGROUND OF THE INVENTION

1. Field of the Invention.

The present invention relates to ink jet printers, and, more particularly, to a manually actuated latch mechanism for releasably securing an ink cartridge within a carriage assembly of an ink jet printer.

2. Description of the Related Art.

Ink jet printing involves the ejection of tiny ink droplets through small nozzles in a controlled manner to create the desired image. Ink is supplied from an ink reservoir to a printhead which includes various passage ways from the reservoir to the nozzle orifice. Energy is applied to the ink from an ink droplet generator near each orifice, which may include the application of electrostatic attraction, the application of oscillating forces from piezo elements, the application of heat from heating elements or the like.

Ink jet printers typically include an ink jet cartridge containing the ink reservoir and a nozzle plate containing the nozzle orifices. It is known to provide the ink cartridge on a carriage assembly. The carriage assembly is moved in transverse directions relative to an advance direction of a print medium being transported through the ink jet printer. As the carriage assembly traverses across the print medium, the ink is jetted at selected locations onto the print medium. In the case of a monochrome printer, a single ink is selectably jetted onto the print medium at pixel locations; and, in the case of a multi-color printer, multiple inks are selectively jetted onto a print medium at pixel locations.

It is necessary that the ink cartridge or cartridges be precisely located in the carriage assembly, and it is known to provide datum surfaces on the cartridge and in the carriage to properly reference the cartridge to an exact location. It is also necessary that the cartridge or cartridges be adequately secured in the carriage so that the rapid back and forth movement of the carriage does not cause a cartridge to become unseated.

Since the ink jet cartridge is a consumable item, having a limited supply of ink therein, it is necessary that the cartridge be replaced from time to time. Such replacement should be an intuitive and simple operation, easily performed by non-technically trained individuals.

Various types of latch mechanisms are known and have been used with varying results. Some mechanisms work well in locking and releasing the cartridge, but the cartridge remains difficult to grasp and remove even after the cartridge has been released.

What is needed in the art is a manually actuated latch mechanism for securing in a releasable manner an ink jet cartridge in a carriage assembly which, by simple operation, both releases the latch and unseats the cartridge.

SUMMARY OF THE INVENTION

The present invention provides a manually actuated carrier latch mechanism for an ink jet printer that provides a user friendly interface for installing and removing a printhead from a carrier.

The invention comprises, in one form thereof, a latch mechanism for releasably securing a printhead cartridge in a printer. The latch mechanism comprises a cradle for receiving a printhead, the cradle including datum pads against which the printhead is referenced. A latch cover has a pivotal connection to the cradle. The latch cover includes structure for engaging a printhead in two perpendicular planes. An actuator is provided for engaging the latch cover in a closed position. The actuator is adapted for releasing the latch cover by movement of the actuator and for moving a printhead cartridge installed in the cradle by further movement of the actuator.

In another form thereof, the invention provides a printer with a printhead cartridge having a bottom, a top, first and second laterally spaced sides, an inner end and an outer end. The cartridge includes at least one datum pad on the bottom, at least one datum pad on the inner end and at least one datum pad on one of the sides. A carriage is adapted for receiving the cartridge, and includes carriage datum pads for mating with each of the datum pads on the cartridge. Biasing means in the carriage operates against the other side of the cartridge. A latch cover is releasably secured overlying the cartridge top and the outer end. An actuator engages the latch cover in a closed position. The actuator is adapted for releasing the latch cover by movement of the actuator, and for lifting the printhead cartridge by further movement of the actuator.

The invention provides, in still another form thereof, a method of unseating an ink jet cartridge installed in a carriage assembly of an ink jet printer, having steps of providing the carriage assembly with a cartridge cradle, a latch cover pivotally connected to the cradle and an actuator for engaging the latch cover, the actuator being pivotally connected to the cradle; releasing the latch cover by moving the actuator; and moving the printhead by further movement of the actuator.

An advantage of the present invention is providing a user-friendly interface for installation and removal of a printhead cartridge in an ink jet printer.

Another advantage is providing a locking mechanism that promotes proper seating of a printhead cartridge in a printer carriage.

Yet another advantage is providing a mechanism that unlocks a printhead cartridge from a carrier, unseats the cartridge, and repositions the cartridge for easy removal.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
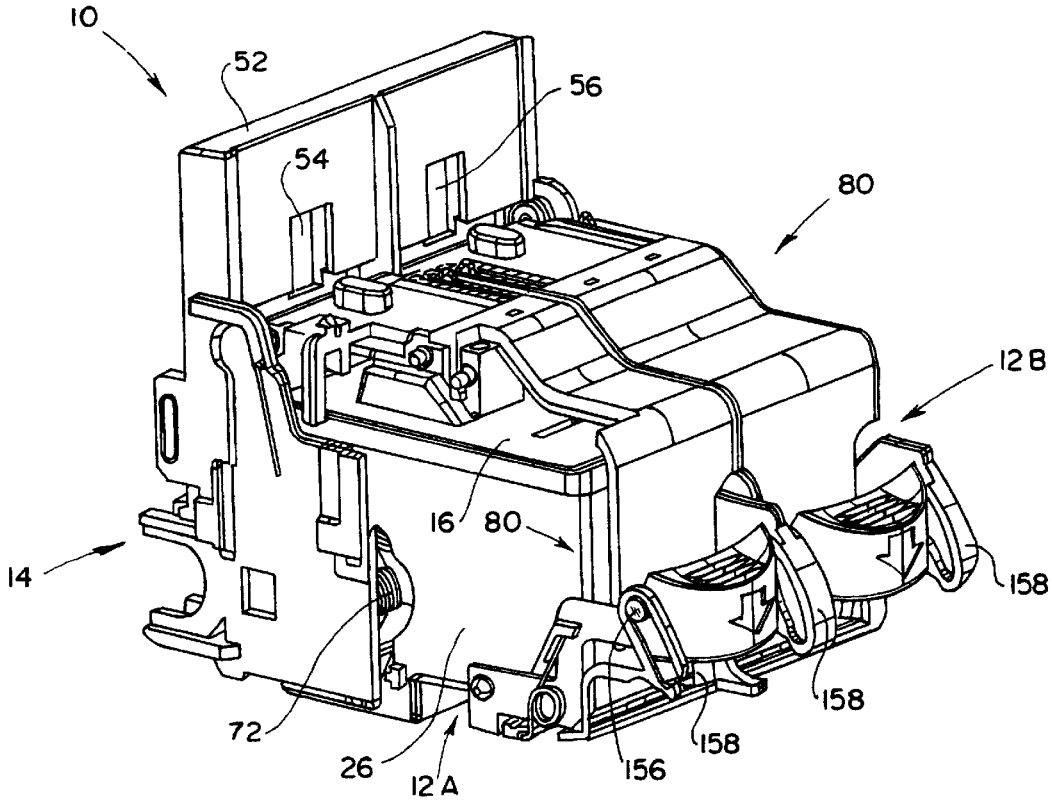
FIG. 1 is a perspective view of a portion of an ink jet printer embodying the present invention.

Referring now to the drawings, and particularly to FIG. 1, there is shown a portion of an ink jet printer 10 of the present invention, which generally includes one or more ink jet print cartridge 12 carried by a carriage assembly 14. Carriage assembly 14 moves back and forth across the printer during normal printing operations to position print head cartridge or cartridges 12 as necessary for the deposit of ink droplets at precise locations on the print medium (not shown). Ink jet cartridge 12 may be of various known constructions and includes one or more chambers for carrying ink therein to be jetted as ink droplets at selected locations on the print medium. In the embodiment shown, two ink jet cartridges 12 are shown, indicated 12A and 12B. Cartridge 12A is assumed to have a single chamber carrying a single ink, and cartridge 12B is assumed to include multiple chambers carrying different inks for color printing.

Each ink jet cartridge (FIG. 2) includes a top 16, a bottom 18, an inner end 20 and an outer end 22. First and second sides 24 and 26 are disposed between top 16 and bottom 18, and between inner end 20 and outer end 22. A printhead nozzle plate 28 is provided at bottom 18.

To properly reference printhead cartridge 12 in printer 10, as will be described in greater detail hereinafter, a plurality of datum pads are provided as reference surfaces, for positioning purposes. One or more datum pads 30, 32, 34 are provided on one of sides 24 and 26, three such datum pads 30, 32 and 34 being shown in the drawings. Datum pads 30, 32 and 34 define a primary datum plane of cartridge 12.

A secondary datum plane of cartridge 12 is defined by datum pads 36 and 38 on inner end 20 and bottom 18, respectively. A single datum pad 40 is provided on inner end 20, for defining a tertiary datum plane of cartridge 12. Those skilled in the art will understand that more or fewer datum pads may be used to define the primary, second and tertiary datum planes. The three datum planes ensure that the printhead is fully constrained when latched in the carrier, and each of the three planes is perpendicular to the other two planes.

Figure 3:
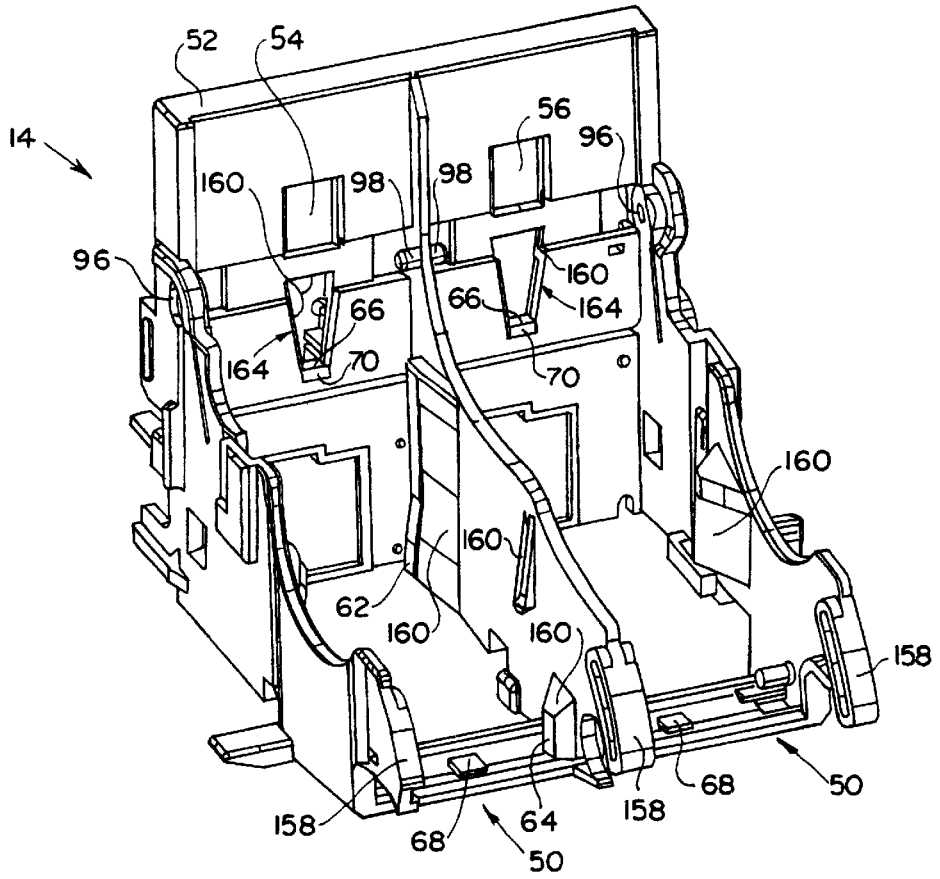
FIG. 3 is a perspective view of a carrier of the present invention.

Carriage assembly 14 defines a cradle 50 adapted for receiving and retaining, in suitable nested position therein, each cartridge 12. Carriage assembly 14 may define one or more cradles 50 and, for example, in a color printer may define two cradles 50, one for a black ink cartridge 12A and one for a color ink cartridge 12B. FIG. 3 shows a carriage assembly 14 having two cradles 50, with similar components of each designated with same reference numbers.

Carriage assembly 14 includes a carriage cover 52, having one or more padded liners 54 and 56 on the inside thereof, one such padded liner 54, 56 for each cradle 50. Liners 54 and 56 may be synthetic foam, or the like.

Cradle 50 generally defines a three sided enclosure for receiving cartridge 12, and includes primary datum plane datum pads 60, 62 and 64 for mating with datum pads 30, 32 and 34 of cartridge 12. Cradle 50 further includes secondary datum plane datum pads 66, 68 for mating with datum pads 36 and 38 of cartridge 12. Cradle 50 further includes a tertiary datum plane datum pad 70 for mating with datum pad 40 of cartridge 12. Thus, by securing cartridge 12 in cradle 50, with datum pads 30, 32, 34, 36, 38 and 40 properly referenced against datum pads 60, 62, 64, 66, 68 and 70, respectively, cartridge 12 is held in cradle 50 in properly oriented position for operation of printer 10.

To properly hold cartridge 12 in cradle 50, biasing force is necessary. To effectuate such biasing force along the primary datum plane defined by datum pads 30, 32 and 34 mated against datum pads 60, 62 and 64, a side bias spring 72 (FIG. 1) is provided, operating against cartridge 12 on the side opposite the side including datum pads 30, 32 and 34. Thus, as shown in the drawings, datum pads 30, 32 and 34 are provided on first side 24 of cartridge 12 and bias spring 72 operates against second side 26 of cartridge 12.

A latch assembly 80 is provided for securing cartridge 12 in cradle 50, and for providing biasing force along the secondary datum plane defined by datum pads 36 and 38 seated against datum pads 66 and 68 as well as biasing force along the tertiary datum plane defined by datum pad 40 mated against datum pad 70. Latch mechanism 80 includes a latch cover 82 and an actuator 84. Cover 82 operates against cartridge top 16 and cartridge outer end 22, while actuator 84 performs both release and locking functions, as well as a lifting function on cartridge 12, each to be described in greater detail hereinafter.

Figure 6:
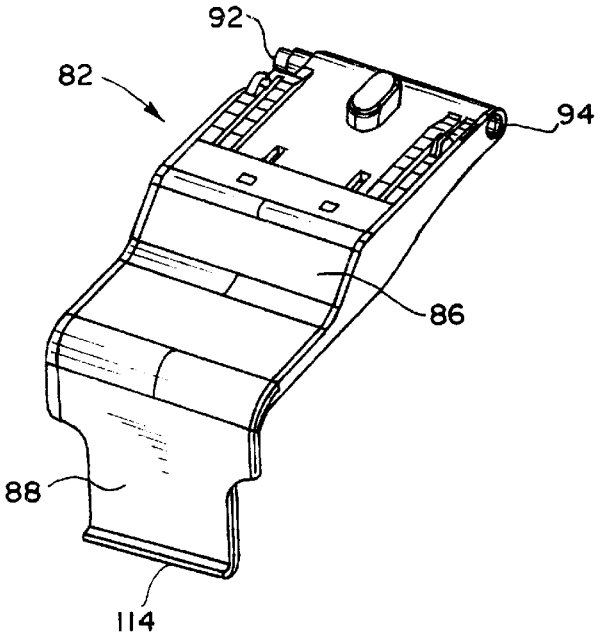
FIG. 6 is a perspective view of a latch cover according to the invention.

Latch cover 82 (FIG. 6) includes a latch cover top 86 substantially overlying cartridge top 16, and a downwardly depending portion 88 generally along outer end 22 of cartridge 12 when latch mechanism 80 is in a closed or locked position as shown in FIG. 1. Latch cover top 86 is joined to carriage assembly 14 by a pivotal connection 90 at an end of latch cover top 86 opposite the end having downwardly depending portion 88. While any suitable pivotal connection may be used, the embodiment shown includes a pin 92 extending outwardly on one side of latch cover top 86 and a hole 94 (FIG. 6) defined in an opposite side of latch cover top 86. A complimentary hole 96 and pin 98 are provided on carriage assembly 14 (FIG. 3), such that pin 92 is received in hole 96 and pin 98 is received in hole 94.

Figure 4:
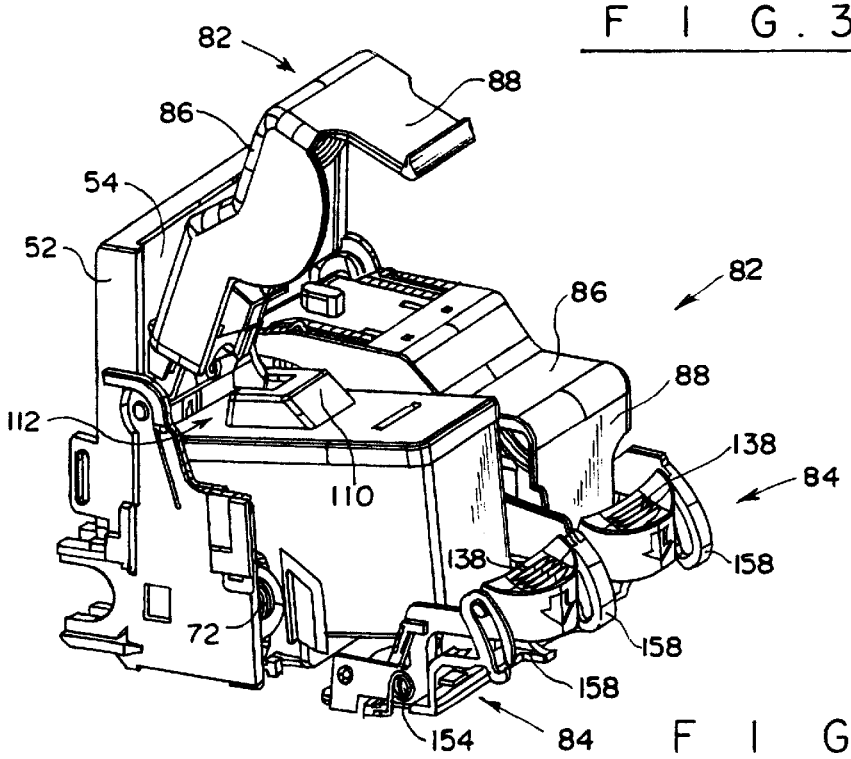
FIG. 4 is a perspective view of the carrier with two cartridges therein, one cartridge being locked in position and the other being unlocked and unseated.
Figure 7:
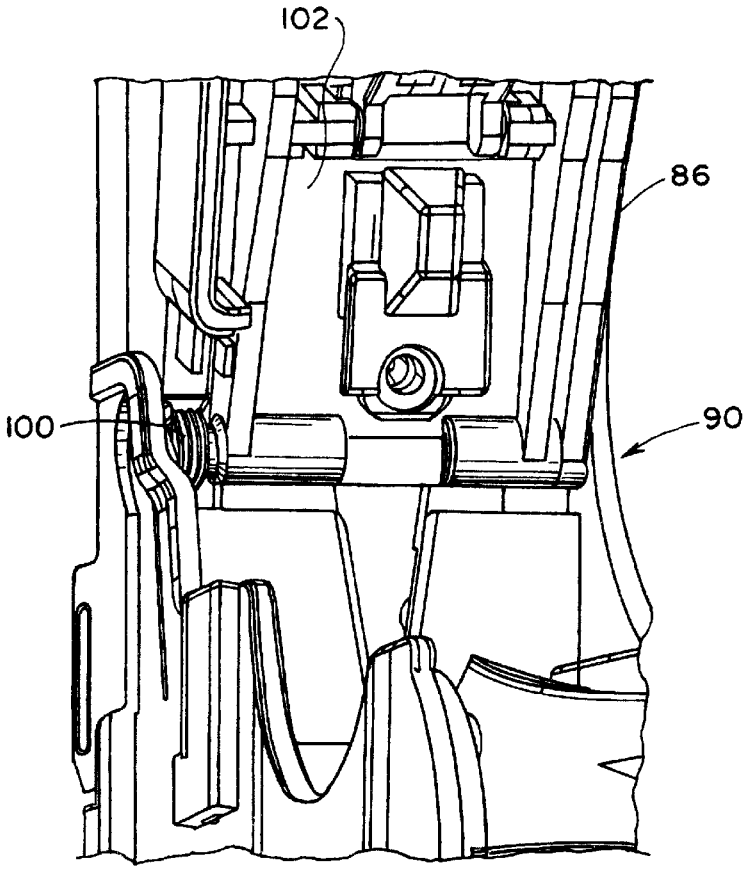
FIG. 7 is an enlarged view of the area of the latch cover connection to the carrier.

A latch torsion spring 100 (FIG. 7), is provided at pivotal connection 90, for biasing latch cover 82 toward an open position, as shown in FIG. 4.

Figure 8:
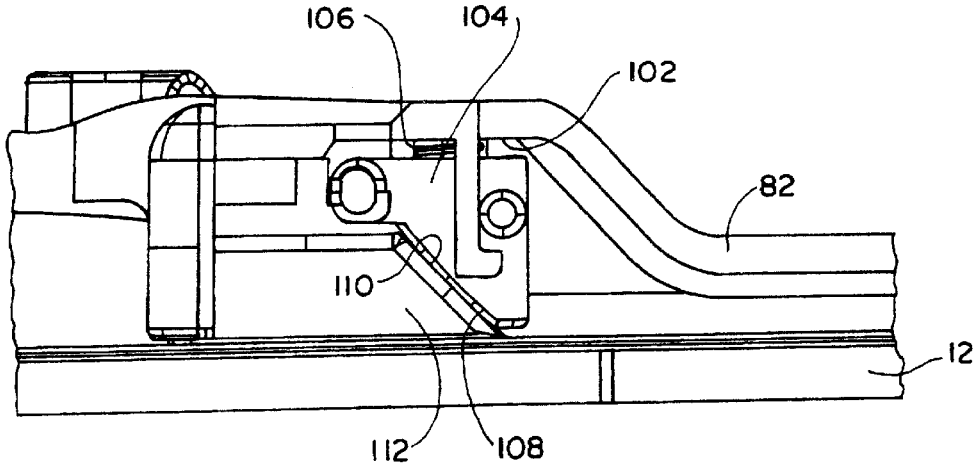
FIG. 8 is an elevational view of the cover, with a side removed, and the cartridge.

On an underside 102 of latch cover top 86, a plunger 104 is provided. Plunger 104, shown in an enlarged view of FIG. 8, is rotatable and vertically movable, and biased by a spring 106. Plunger 104 includes a curved, ramp-like surface 108 for mating against a complementary ramp-surface 110 of a body 112 provided on, or as part of, cartridge top 16. The generally downwardly biasing force of spring 106 on plunger 104 provides the secondary datum plane and tertiary datum plane biasing forces through ramp surfaces 108 and 110. The curvature of surface 108 assures that the biasing force on surface 110 is normal to, and generally centered on surface 110.

Downwardly depending portion 88 of latch cover top 86 includes an outwardly extending lip 114 at the lower end thereof, for functioning with actuator 84, in a manner to be described subsequently herein, to secure latch mechanism 80 in the closed or locked position.

Figure 9:
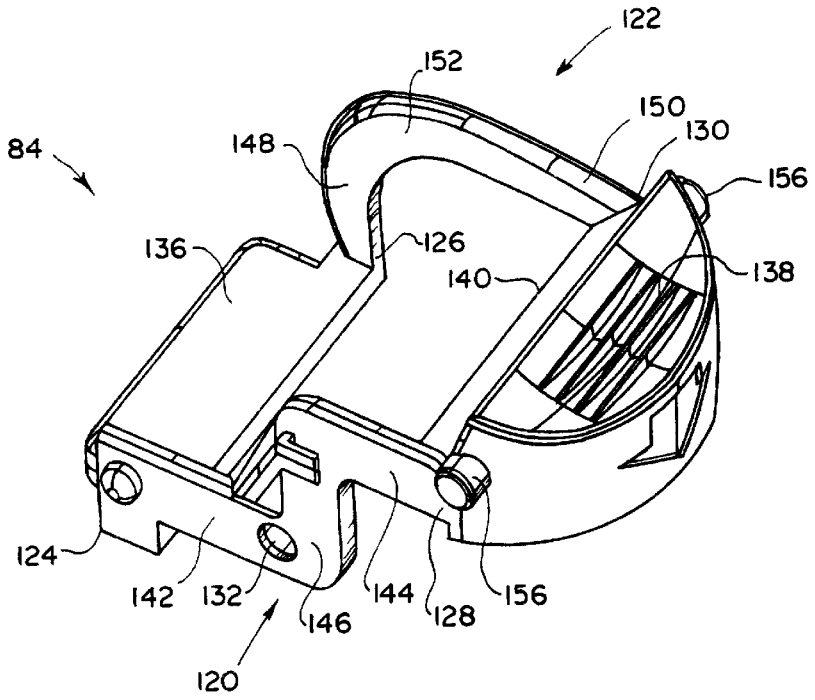
FIG. 9 is a perspective view of an actuator of the invention.
Figure 10:
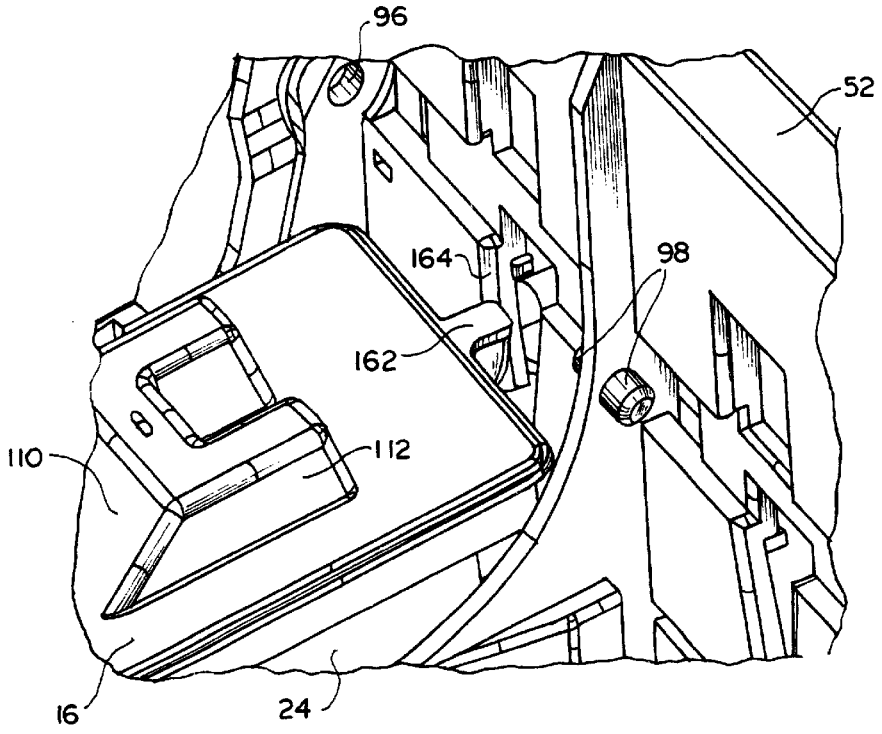
FIG. 10 is an enlarged, fragmentary perspective view of the cartridge and carrier.

Actuator 84, shown individually in FIG. 9, includes first and second arms 120 and 122 spaced from each other, and provided generally along second side 26 and first side 24, respectively, of cartridge 12, near cartridge bottom 18. Each first arm 120 and second arm 122 includes a first or inner end 124 and 126, respectively, and a second or outer end 128 and 130, respectively. First arm 120 is pivotally connected to carriage assembly 14 at a pivot point 132 intermediate first end 124 and second end 128. A lift bar 136 is disposed between first arm 120 and second arm 122 generally at first end 124 and first end 126 thereof, with lift bar 136 being disposed beneath cartridge 12. An actuator touch pad 138 is disposed between first arm 120 and second arm 122 generally at second end 128 and second end 130 thereof, respectively. Touch pad 138 is disposed generally outwardly of downwardly depending portion 88 with latch cover 82 in the closed or locked position. Touch pad 138 includes a bottom edge 140 which overlies outwardly extending lip 114 in the locked position of latch cover 82.

As shown most clearly in FIG. 9, first arm 120 is generally step-shaped in side view, having a generally horizontal lower segment 142 and an upper segment 144 joined by a riser 146. Second arm 122 has a generally vertical inner segment 148 and a generally horizontal outer segment 150, joined by a curved segment 152. Pivot 132 is provided generally at a lower portion of riser 146, between lower segment 142 and upper segment 144 of first arm 120. Thus, downward pressure on touch pad 138, causing downward movement thereof, also causes outward movement of touch pad 138, away from downwardly depending portion 88. At the same time, first ends 124 and 126 are caused to move upwardly, raising lift bar 136. An actuator spring 154 is provided, biasing first arm 120 in the upward or locked direction of touch pad 138. Movement of touch pad 138 is guided by a knob or knobs 156 traveling in a guide bracket 158.

Figure 5:
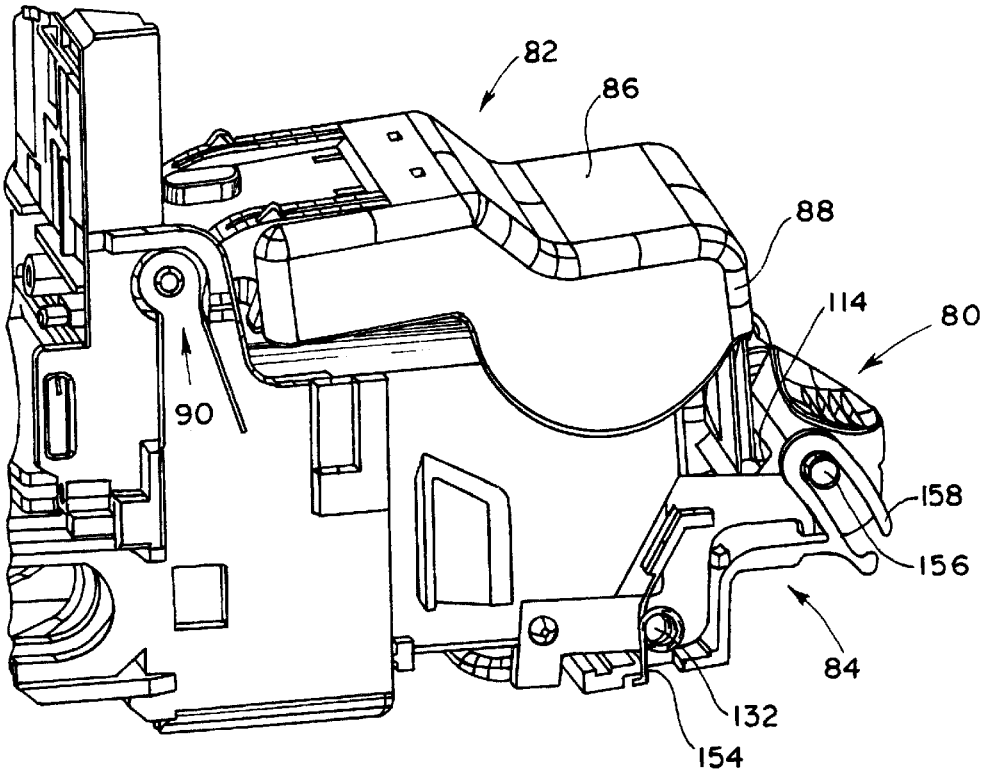
FIG. 5 is a perspective view of the carrier and one of the cartridges.

For removal of a printhead cartridge 12, from the closed or locked position shown in FIG. 1, wherein cartridge 12 is secured in cradle 50, a user of the device pushes downwardly on touch pad 138, causing downward and outward movement of pad 138 away from downwardly depending portion 88 of latch cover 82. From a position in which bottom edge 140 overlaps outwardly extending lip 114, bottom edge 140 is moved away from lip 114, as arm 120 is pivoted about pivot point 132, thus freeing latch cover 82 from engagement with actuator 84. FIG. 5 illustrates a time in the procedure just after lip 114 has been released, and latch cover 82 has begun to rise. Latch torsion spring 100 causes latch cover 82 to rotate fully upwardly to an opened position illustrated in FIG. 4. Padded liners 54, 56 absorb energy from latch cover 82 striking carriage cover 52 as latch cover 82 is rotated about pivotal connection 90 to a fully opened position.

Figure 11:
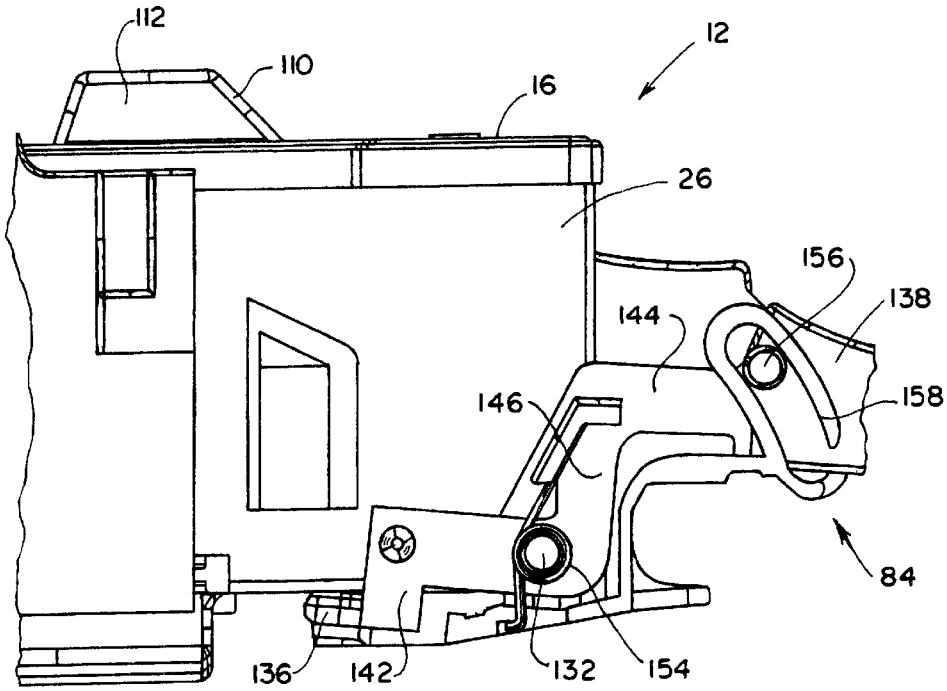
FIG. 11 is a side view of the carrier and cartridge at an intermediate point during cartridge removal or installation.
Figure 12:
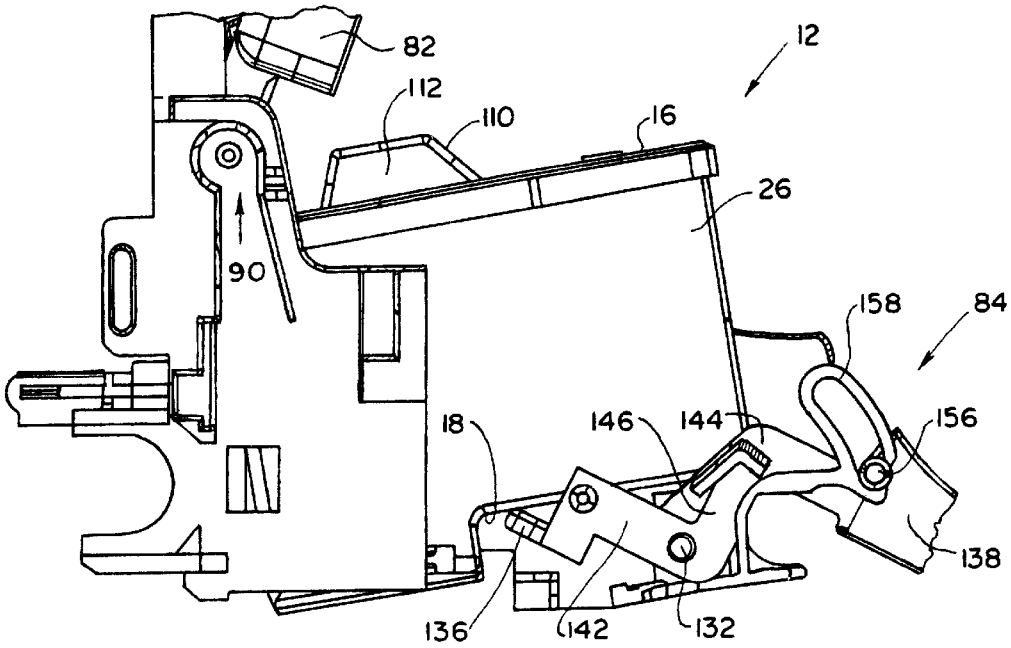
FIG. 12 is a view similar to FIG. 11, but at a more advanced point during cartridge removal.

Continued downward movement of touch pad 138 raises lift bar 136 into engagement against bottom 18 of cartridge 12 (FIG. 11). Still further downward movement of touch pad 138 lifts cartridge 12 away from its nested position in cradle 50 (FIG. 12). Thus freed, elevated and exposed, cartridge 12 can be readily grasped for removal from carriage assembly 14.

It should be noted that upon cessation of downward pressure on touch pad 138, actuator spring 154 rotates first arm 120 about pivot point 132, elevating touch pad 138 to the upward position illustrated in FIG. 4. However, cartridge 12 will remain in its elevated position, as the side biasing force exerted by side bias spring 72 is sufficient to wedge cartridge 12 in the lifted position.

It should be noted further that the stored potential energy in plunger spring 106 operating against plunger 104, and thereby ramp surface 108 against ramp surface 110, further assists in elevating cover 82 to its fully opened position. Latch torsion spring 100 will retain latch cover 82 in the elevated or opened position.

For installation of a printhead cartridge 12, if latch cover 82 has been closed without a cartridge 12 in cradle 50, touch pad 138 is depressed to release latch cover 82, allowing latch cover 82 to rotate to its elevated position, as described above. Printhead cartridge 12 is then placed in generally proper position in cradle 50. Cartridge 12 is properly positioned and seated in cradle 50 by pushing downwardly on latch cover top 86, causing ramp surfaces 108 and 110 to engage, and, during initial stages, causing depending portion 88 to engage against outer end 22, thereby pushing cartridge 12 both downwardly and inwardly.

Figure 2:
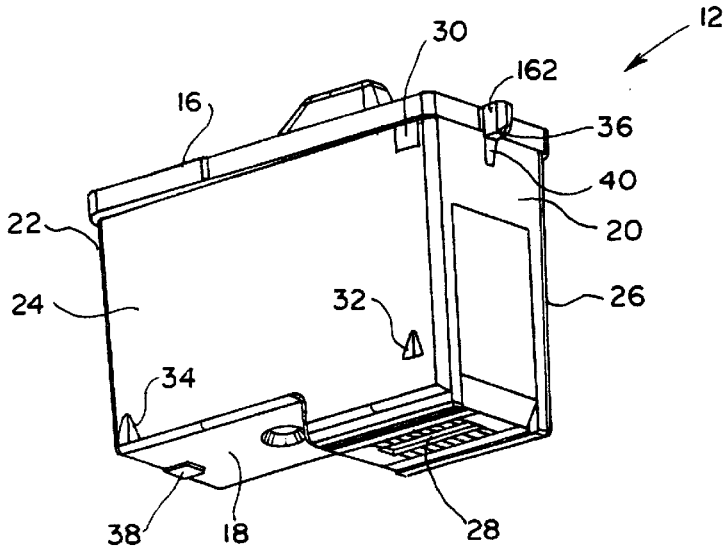
FIG. 2 is a perspective view of a printhead cartridge.

To assist in directing cartridge 12 properly into cradle 50, cradle 50 includes a plurality of features 160, such as ramps or transitions, to guide printhead cartridge 12 into and out of its properly seated position. Features 160 provide sliding and directing surfaces for cartridge 12 between its seated position as shown in FIG. 5 and its elevated position as shown in FIG. 4. To further aid in directing cartridge 12 to a proper nested position, one or more features 160, may be provided as a V-shaped protuberance 162 received in a V-shaped opening 164 (FIG. 3). Initially protuberance 162 is received in a wide region of V-shaped opening 164, and continued downward movement of cartridge 12 directs protuberance 162 downwardly in opening 164 to its final resting position. As illustrated in FIG. 2, a bottom surface of protuberance 162 defines datum pad 36, and the bottom of groove 164 defines datum pad 66.

As latch cover 82 is pressed to its lower most position, lip 114 slides past touch pad 138, and specifically bottom edge 140 thereof, until lip 114 is directly beneath bottom edge 140. FIG. 5, previously described as illustrating the position of cover 82 just after lip 114 has been released, also illustrates the cover position just prior to lip 114 sliding past edge 140, as cartridge 12 is installed. Since actuator spring 154 biases touch pad 138 into the upper or lifted position, as lip 114 is slid past bottom edge 140, touch pad 138 is biased upwardly and inwardly such that bottom edge 140 overlies lip 114. Releasing downward pressure on latch cover 82 causes slight upward movement of latch cover 82 by latch torsion spring 100, and, when a cartridge 12 is installed, by plunger spring 106 through plunger 104, until lip 114 engages against bottom edge 140. The combined effect of actuator spring 154 biasing touch pad 138 upwardly and inwardly and latch torsion spring 100 (and plunger spring 106 if a cartridge 12 is installed) biasing latch cover 82 upwardly causes locked engagement of bottom edge 140 against lip 114.

It should also be noted that, as cartridge 112 is inserted into cradle 50, and pushed downwardly by latch cover 82, side biasing spring 72 and continued relative movement of ramp surface 108 along ramp surface 110 by plunger 104 properly mates datum pads 30, 32, 34, 36, 38 and 40 against datum pads 60, 62, 64, 66, 68 and 70.

The present invention provides a user friendly interface for installing and removing a printhead cartridge from a carrier. Spring loading the latch mechanism ensures proper latching of the device upon installation of the cartridge, and facilitates removal of the cartridge by readily opening and lifting the cover away from the installed cartridge. A single movement of the actuator both unlocks or delatches the latch mechanism, and lifts the cartridge to unseat the cartridge and expose the cartridge for ready removal thereof Installation and latching are facilitated by requiring only gross positioning of the cartridge, with final positioning thereof being effectuated by the latch mechanism upon closing of the latch. Locking of the latch mechanism is automatic in performing the closing function.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A latch mechanism for releasably securing a printhead cartridge in a printer, said latch mechanism comprising:

a cradle for receiving a printhead cartridge, said cradle including datum pads against which the printhead cartridge is referenced;

a latch cover having a pivotal connection to said cradle, said latch cover including structure for engaging a printhead cartridge in two perpendicular planes; and an actuator releasably connected to said latch cover, and positioned for engaging said latch cover in a closed position, said actuator adapted for releasing a connection to said latch cover by movement of said actuator and for moving a printhead cartridge installed in said cradle by continued movement of said actuator.

2. The latch mechanism of claim 1, including a spring biasing said latch cover to an open position.

3. The latch mechanism of claim 1, including a spring biasing said actuator to the closed position.

4. The latch mechanism of claim 3, including a spring biasing said latch cover to an open position.

5. The latch mechanism of claim 1, said pivotal connection including a pin on one side of said latch cover and said latch cover defining a hole on another side thereof, and said carriage defining a hole for receiving said pin on said latch cover and having a pin for insertion in said hole defined by said latch cover.

6. The latch mechanism of claim 1, said latch cover having a top with first and second ends, and a downwardly extending portion, said pivotal connection being disposed at one of said ends and said downwardly extending portion disposed at the other of said ends.

7. The latch mechanism of claim 6, said actuator adapted for engaging said downwardly extending portion of said latch cover.

8. The latch mechanism of claim 7, said actuator including first and second arms spaced from each other, each of said arms having an arm first end and an arm second end and being pivotally connected to said cradle at points intermediate said arm first end and said arm second end.

9. The latch mechanism of claim 8, said actuator including a lift bar disposed between said first and second arms beneath a printhead cartridge received in said cradle.

10. The latch mechanism of claim 8, said actuator including a touch pad disposed between said first and second arms outwardly of said latch cover in the closed position.

11. The latch mechanism of claim 10, said downwardly extending portion including an outwardly extending lip, and said touch pad including an edge overlying said lip with said latch cover disposed in the closed position.

12. The latch mechanism of claim 11, said actuator including a lift bar disposed between said first and second arms beneath a printhead cartridge received in said cradle.

13. The latch mechanism of claim 12, including a spring biasing said latch cover to an open position.

14. The latch mechanism of claim 12, including a spring biasing said actuator to the closed position.

15. The latch mechanism of claim 14, including a spring biasing said latch cover to an open position.

16. A printer comprising:

a printhead cartridge having a bottom, a top, first and second laterally spaced sides, an inner end and an outer end, said cartridge including at least one datum pad on said bottom, at least one datum pad on said inner end and at least one datum pad on one of said sides;

a carriage adapted for receiving said cartridge, and including carriage datum pads for mating with each of said datum pads on said cartridge;

biasing means in said carriage operating against the other side of said cartridge;

a latch cover releasably secured overlying said cartridge top and said outer end; and an actuator for engaging said latch cover in a closed position, said actuator adapted for releasing said latch cover by movement of said actuator, and for lifting said printhead cartridge by further movement of said actuator.

17. The printer of claim 16, said latch cover having a top adapted for engaging said printhead cartridge top with said latch in said closed position, and a downwardly extending portion overlying said printhead cartridge outer end; and said actuator adapted for engaging said downwardly extending portion of said latch cover.

18. The printer of claim 17, said downwardly extending portion including an outwardly extending lip, and said actuator including an edge overlying said lip with said latch cover in the closed position.

19. The printer of claim 17, said actuator including first and second arms spaced from each other, each of said arms having an arm first end and an arm second end and being pivotally connected to said carrier at points intermediate said arm first end and said arm second end.

20. The printer of claim 19, said actuator including a lift bar disposed between said first and second arms beneath said printhead cartridge.

21. The printer of claim 20, said actuator including a touch pad disposed between said first and second arms outwardly of said latch cover in the closed position.

22. The printer of claim 21, including a spring biasing said latch cover to an open position.

23. The printer of claim 21, including a spring biasing said actuator to the closed position.

24. The printer of claim 23, including a spring biasing said latch cover to an open position.

25. The printer of claim 16, including guide surfaces on said cartridge and in said carriage for directing said cartridge between a final nested position in said carriage and an exposed position.

26. The printer of claim 25, said guide surfaces including a V-shaped protuberance and a V-shaped notch for receiving said protuberance.

27. The printer of claim 16, including a spring biased plunger operating between said printhead cartridge top and said latch cover.

28. The printer of claim 27, said printhead cartridge including a surface for engagement with said plunger, and said plunger having a curved surface directing biasing force substantially normal to and centered on said cartridge surface.

29. A method of unseating an ink jet cartridge installed in a carriage assembly of an ink jet printer, comprising the steps of:

providing the carriage assembly with a cartridge cradle, a latch cover pivotally connected to the cradle and an actuator for releasably engaging the latch cover, the actuator being pivotally connected to the cradle;

releasing the latch cover by depressing the actuator; and moving the cartridge by continued depressing of the actuator.

30. The method of claim 29, further including the step of biasing the cover toward an open position with a spring.

31. The method of claim 29, including biasing the actuator toward a closed position with a spring.

32. The method of claim 29, wherein said step of moving the cartridge includes lifting the cartridge with a bar beneath the cartridge.

* * * * *